US008050588B2

(12) United States Patent
Inukai et al.

(10) Patent No.: US 8,050,588 B2
(45) Date of Patent: Nov. 1, 2011

(54) IMAGE FORMING APPARATUS WITH LOW VOLTAGE POWER SUPPLY

(75) Inventors: Katsumi Inukai, Iwakura (JP); Hiroyuki Naganawa, Kasugai (JP); Junji Uehara, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 421 days.

(21) Appl. No.: 12/181,670

(22) Filed: Jul. 29, 2008

(65) Prior Publication Data

US 2009/0035008 A1 Feb. 5, 2009

(30) Foreign Application Priority Data

Jul. 31, 2007 (JP) ..... 2007-199062

(51) Int. Cl.
*G03G 15/00* (2006.01)

(52) U.S. Cl. ..... 399/88; 399/90

(58) Field of Classification Search ..... 399/88, 399/90; 174/659, 660, 665, 668
See application file for complete search history.

(56) References Cited

U.S. PATENT DOCUMENTS

| | | | | |
|---|---|---|---|---|
| 3,110,753 | A * | 11/1963 | Witort | 174/70 R |
| 4,640,479 | A * | 2/1987 | Shely et al. | 248/56 |
| 5,406,032 | A * | 4/1995 | Clayton et al. | 174/151 |
| 7,304,251 | B1 * | 12/2007 | Gretz et al. | 174/655 |
| 7,333,745 | B2 * | 2/2008 | Han et al. | 399/88 |
| 7,403,741 | B2 * | 7/2008 | Yoshihara et al. | 399/411 |
| 7,664,425 | B2 * | 2/2010 | Tsusaka | 399/107 |
| 2005/0150678 | A1 | 7/2005 | Takase et al. | |
| 2006/0034633 | A1 | 2/2006 | Tsusaka et al. | |

FOREIGN PATENT DOCUMENTS

| | | | |
|---|---|---|---|
| JP | 49-000498 | | 4/1947 |
| JP | 57-089387 | | 11/1955 |
| JP | 46-014431 | | 5/1971 |
| JP | 63-111715 | | 7/1988 |
| JP | 04-085525 | | 7/1992 |
| JP | 05-045917 | | 6/1993 |
| JP | 07131166 | A * | 5/1995 |
| JP | 07-029763 | | 6/1995 |
| JP | 11-298165 | | 10/1999 |
| JP | 2001-196762 | | 7/2001 |
| JP | 2002-010450 | | 1/2002 |
| JP | 2005-199812 | | 7/2005 |
| JP | 2006-053255 | | 2/2006 |
| JP | 2006-156832 | | 6/2006 |

OTHER PUBLICATIONS

Notification of Reasons for Refusal for Japanese Application No. 2007-199062 mailed on Aug. 11, 2009.

* cited by examiner

*Primary Examiner* — Robert Beatty
(74) *Attorney, Agent, or Firm* — Banner & Witcoff, Ltd.

(57) ABSTRACT

An image forming apparatus capable of shortening a time needed for the assembly work is provided. The image forming apparatus of the invention comprises a low-voltage power supply and a housing, wherein the low-voltage power supply includes a substrate provided with a low-voltage power supply circuit, a pair of connection cords each connected to the substrate and an external power supply, a casing made of metal and provided with an accommodation portion inside which the substrate is fixed and a notch located on an opening edge of the accommodation portion, a lid body made of metal and configured to cover the accommodation portion and to define a cord insertion port by closing the notch, and a ring body made of resin and inserted into the notch in a state where both the connection cords are inserted in the ring body and to be attached to the cord insertion port.

3 Claims, 8 Drawing Sheets

IMAGE FORMING APPARATUS WITH LOW VOLTAGE POWER SUPPLY

CROSS-REFERENCE TO RELATED APPLICATION

The present application is based upon and claims the benefit of priority from the prior Japanese Patent Application No. 2007-199062 filed with the Japanese Patent Office on Jul. 31, 2007, the entire subject matter of which are incorporated herein by reference.

BACKGROUND

An image forming apparatus in the related art is disclosed in FIG. 16 of JP-A-2006-53255. This image forming apparatus includes a low-voltage power supply and a housing that accommodates the low-voltage power supply. This image forming apparatus is configured in such a manner that a voltage supplied from an external power supply, such as an electric outlet, is lowered by the low-voltage power supply to activate a driving mechanism, such as a motor, and an electronic component, such as a sensor, for performing an image forming operation.

SUMMARY

An image forming apparatus according to one aspect of the invention comprises a low-voltage power supply and a housing configured to accommodate therein the low-voltage power supply, wherein the low-voltage power supply includes a substrate provided with a low-voltage power supply circuit, a pair of connection cords each soldered to the substrate at one end and connected to an external power supply that supplies power to the low-voltage power supply circuit at the other end, a casing made of metal and provided with an accommodation portion inside which the substrate is fixedly accommodated and a notch made in a part of an opening edge of the accommodation portion, a lid body made of metal and configured to cover the accommodation portion when assembled to the casing while abutting on the opening edge and to define a cord insertion port by closing the notch, and a ring body made of resin and configured to be inserted into the notch in a state where both the connection cords are inserted in the ring body and to be attached to the cord insertion port when the lid body is assembled to the casing.

BRIEF DESCRIPTION OF THE SEVERAL VIEWS OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF THE PREFERRED EMBODIMENTS

A low-voltage power supply of the image forming apparatus in the related art typically includes a substrate provided with a low-voltage power supply circuit, a pair of connection cords each soldered to the substrate at one end and connected to an external power supply that supplies power to the low-voltage power supply circuit at the other end, a casing made of metal and provided with an accommodation portion inside which the substrate is fixedly accommodated and a notch made in a part of an opening edge of the accommodation portion, and a lid body made of metal and configured to cover the accommodation portion when assembled to the casing while abutting on the opening edge and to define a cord insertion port by closing the notch.

In the assembly step of the low-voltage power supply, when the lid body is assembled to the casing in a state where both the connection cords are disposed in the notch, the connection cords are extracted to the outside of the low-voltage power supply from the cord insertion port.

When the lid body is to be assembled to the casing, the worker has to work with the greatest care so that both the connection cords will not come off from the notch in order to prevent inconveniences, such as disconnection of both connection cords occurring when pinched between the lid body and the casing, and a short occurring when coming into contact with the lid body or the casing. Accordingly, it is difficult to shorten a time needed for the assembly work with the image forming apparatus in the related art.

Hereinafter, Embodiments 1 through 5 as implementations of the invention will be described with reference to the drawings. In FIG. 1 through FIG. 11, FIG. 13, and FIG. 15, the upper side of each drawing is referred to as the top or upper side, and the lower side is referred to as the bottom or lower side. In FIG. 12 and FIG. 14, the front side of each drawing is referred to as the top or upper side, and the back side is referred to as the bottom or lower side.

Embodiment 1

Figure 1:
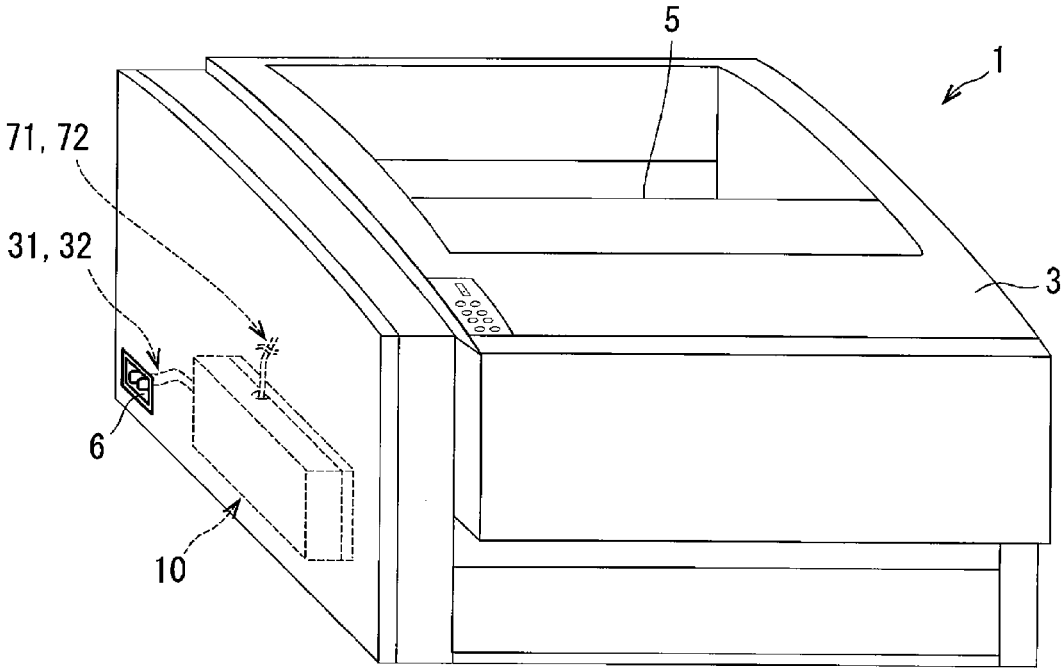
FIG. 1 is a perspective view of an image forming apparatus of Embodiment 1.

As shown in FIG. 1, an image forming apparatus 1 of Embodiment 1 includes a housing 3, an image forming portion (not shown), and a low-voltage power supply unit 10.

Overall Configuration

The housing 3 is a generally boxed-shaped body made of resin, metal, and other typical material. A discharge tray 5, onto which a sheet having an image thereon is discharged, is recessed in the external top surface of the housing 3. In addition, a connector 6 is provided on an external side face of the housing 3.

The image forming portion (not shown) is accommodated in a center of the housing 3. The image forming portion includes an image forming portion main body (not shown), and a sheet feeding cassette and a sheet feeding mechanism (none of which is shown) for feeding sheets to the image forming portion main body. The image forming portion main body is of a known configuration adopting a typical image forming method, such as an electrophotographic method and an ink-jet method. The sheet feeding cassette and the sheet feeding mechanism are also of a known configuration. Accordingly, detail descriptions of the image forming portion main body, the sheet feeding cassette, and the sheet feeding mechanism are omitted herein.

The image forming portion is capable of transporting sheets one by one from the sheet feeding cassette to the image forming portion main body by means of the sheet feeding mechanism and discharging a sheet onto the discharge tray 5 after an image is formed on the sheet in the image forming portion main body.

A low-voltage power supply unit 10, which will be described in detail below, is accommodated inside the housing 3 on one side. The low-voltage power supply unit 10 is connected to the connector 6 via a pair of connection cords 31 and 32.

A substrate 20 (described in detail below with reference to illustrations in FIG. 3 and so forth) is fixedly accommodated inside the low-voltage power supply unit 10. The substrate 20 is provided with a low-voltage power supply circuit that lowers a 100-V voltage to a low voltage of about 6 V. Power is supplied to the substrate 20 inside the low-voltage power supply unit 10 from a 100-V home electric outlet (not shown) as an external power supply via a power supply cord (not shown), the connector 6, and a pair of the connection cords 31 and 32, so that the power is lowered by the low-voltage power supply circuit. The lowered power is then supplied to a fixing unit, which is included in the image forming portion, via a pair of inner wiring cords 71 and 72 extracted from the low-voltage power supply unit 10. Hereinafter, the low-voltage power supply 10 will be described more in detail.

Low-Voltage Power Supply Unit

Figure 2:
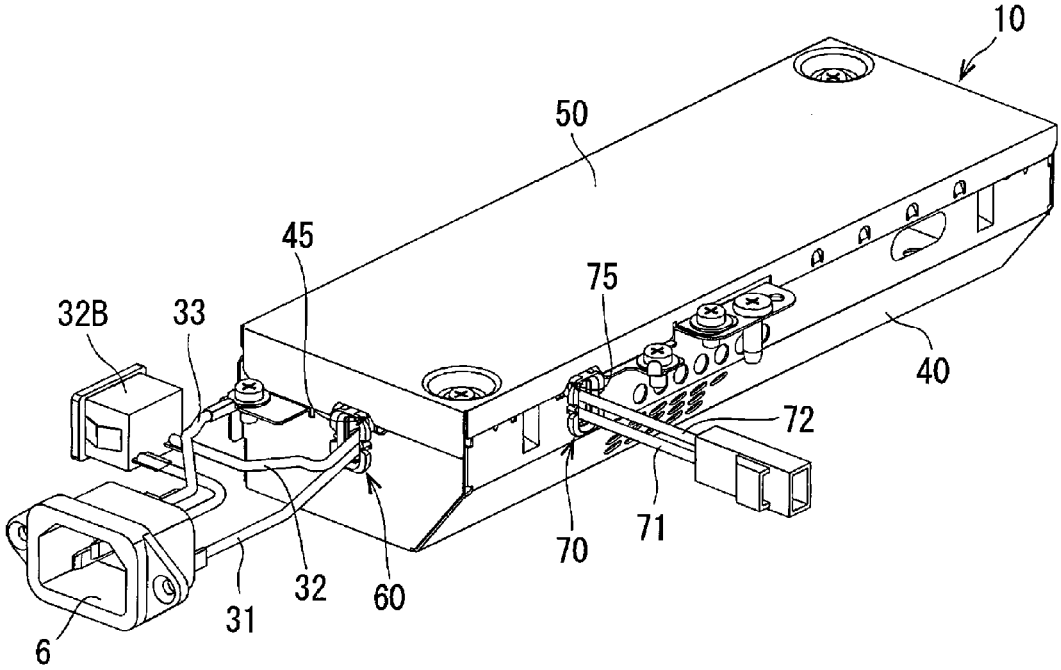
FIG. 2 is a perspective view showing a low-voltage power supply unit in the image forming apparatus.
Figure 3:
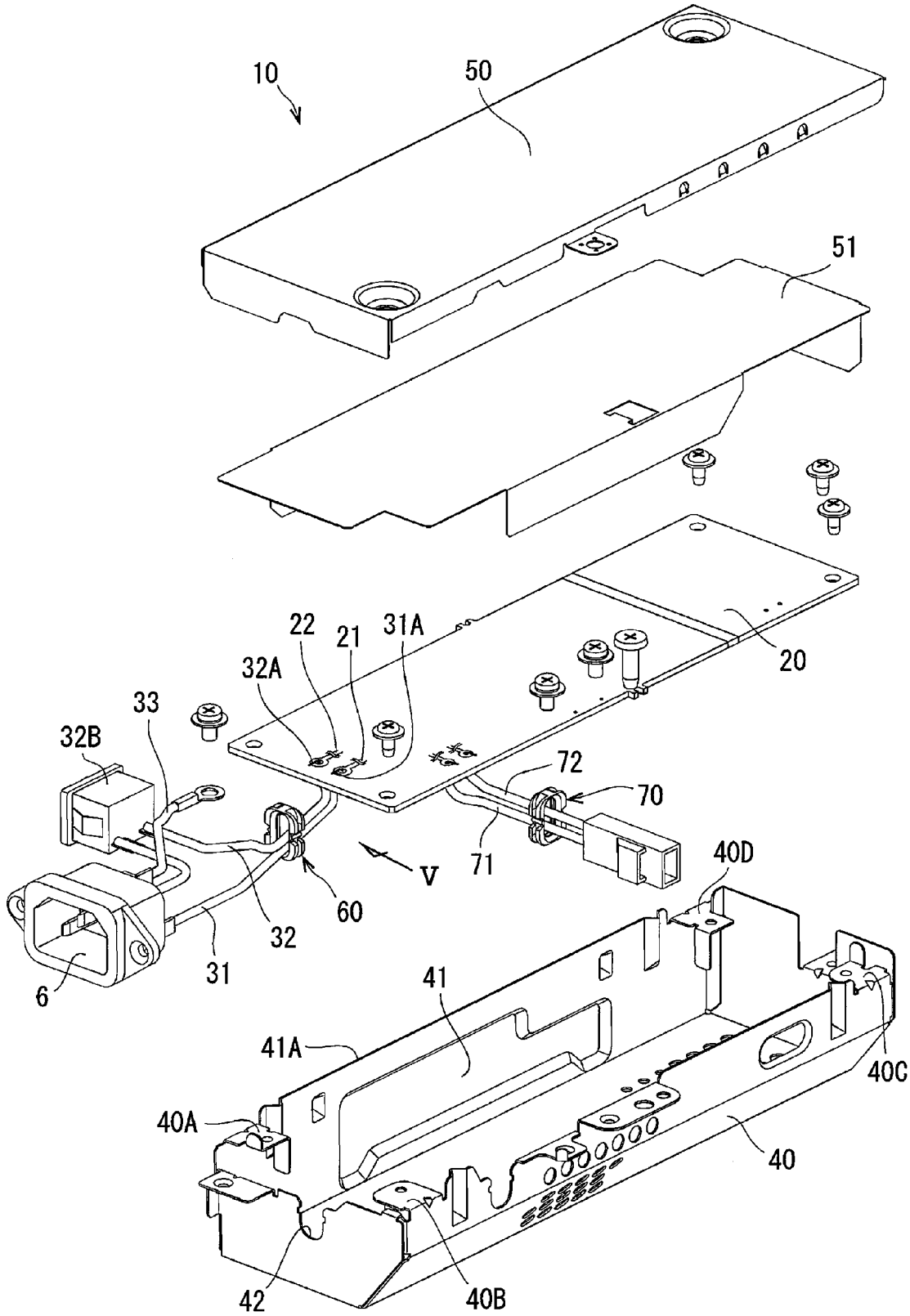
FIG. 3 is an exploded perspective view showing the low-voltage power supply unit in a state before it is assembled in the image forming apparatus.

As shown in FIG. 2 and FIG. 3, the low-voltage power supply unit 10 includes the substrate 20, a pair of the connection cords 31 and 32, a casing 40 and a lid body 50 each made of metal to accommodate the substrate 20 therein, and a ring body 60. The low-voltage power supply unit 10 also includes a pair of the inner wiring cords 71 and 72 and a ring body 70.

As shown in FIG. 3, the substrate 20 is provided with the low-voltage power supply circuit, which is formed by disposing a wiring pattern and plural electric circuit elements on the top face side of an elongate rectangular insulation substrate. In this embodiment, the low-voltage power supply circuit is of a known configuration to lower 100-V voltage supplied from the external power supply, such as an electric output, to a low voltage of about 6 V. Accordingly, illustrations of the wiring pattern and the electric circuit elements on the substrate 20 are omitted herein.

As shown in FIG. 3, the casing 40 is formed by applying sheet metalworking to a metal thin plate and is shaped like an elongate box opening at the top. An accommodation portion 41 capable of accommodating the substrate 20 therein is defined inside the casing 40. Substrate supporting pieces 40A, 40B, 40C, and 40D are formed around four corners defining the accommodation portion 41 by bending the metal thin plate. By fastening the substrate 20 to the casing 40 with screws while the four corners of the substrate 20 abut on the substrate supporting pieces 40A, 40B, 40C, and 40D, the substrate 20 can be fixedly accommodated in the accommodation portion 41 with a suitable clearance left between the substrate 20 and inner wall surfaces of the casing 40.

As shown in FIG. 3, the lid body 50 is formed by applying sheet metal processing to a rectangular, thin metal plate and is shaped like a lid by bending peripheral edges of the metal plate downward. A partition plate 51 is attached to the lid body 50 on the bottom face side. The lid body 50 is assembled and fastened to the casing 40 with screws in such a manner that it abuts on an opening edge 41A in order to cover the accommodation portion 41.

As shown in FIG. 2, the casing 40 is connected to a grounding terminal of the connector 6 via a ground wire 33. As the low-voltage power supply circuit provided on the substrate 20 is surrounded with the casing 40 and the lid body 50 each made of metal and connected to ground, it is possible to achieve a configuration to eliminate risks, such as an electric leakage from the power supply circuit to which high-voltage power is supplied.

As shown in FIG. 2, a pair of the connection cords 31 and 32 is extracted from a cord insertion port 45 positioned at a joint of the casing 40 and the lid body 50 on a short side of the low-voltage power supply unit 10 via the ring body 60 described below. Also, a pair of the inner wiring cords 71 and 72 is extracted from a cord insertion port 75 positioned at a joint of the casing 40 and the lid body 50 on a long side of the low-voltage power supply unit 10 via a ring body 70, which is identical in shape to the ring body 60. The configuration to extract the inner wiring cords 71 and 72 from the cord insertion port 75 via the ring body 70 is the same as the configuration to extract the connection cords 31 and 32 from the cord insertion port 45 via the ring body 60. Accordingly, the extraction configuration of the connection cords 31 and 32 alone will be described and a description of the inner wiring cords 71 and 72 is omitted herein.

Extraction Configuration of Connection Cords

Initially, as shown in FIG. 3, a description will be made as to a state before the substrate 20, the casing 40, and the lid body 50 are assembled to form the low-voltage power supply unit 10.

The connection cords 31 and 32 are typical electric wires coated with resin, and as shown in FIG. 3, they are soldered, respectively, to wiring end portions 21 and 22 provided at a short side of the substrate 20. The wiring end portions 21 and 22 form part of the wiring pattern (not shown) that forms the low-voltage power supply circuit.

To be more concrete, as shown in enlargement in FIG. 5, one ends 31A and 32A of the connection cords 31 and 32 (the one end 32A is hidden by the one end 31A in FIG. 5) are inserted, respectively, into terminal holes 21A and 22A (the terminal hole 22A is hidden by the terminal hole 21A in FIG. 5) provided to penetrate through the wiring end portions 21 and 22, respectively (the wiring end portion 22 is hidden by the wiring end portion 21 in FIG. 5) from below. The ends 31A and 32A are bent on the top face side of the substrate 20 and soldered to the wiring end portions 21 and 22, respectively.

Figure 5:
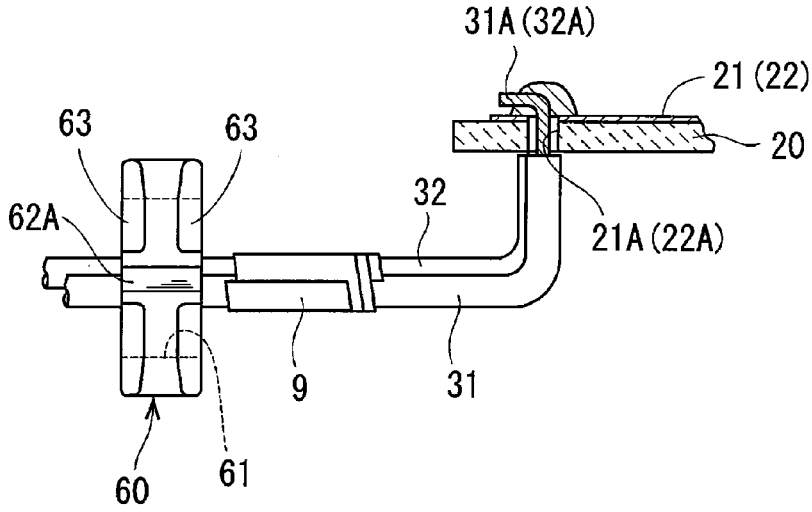
FIG. 5 is a side view (partial cross section) showing a substrate, connection cords, and a ring body when viewed in a direction indicated by an arrow V in FIG. 3 in the image forming apparatus of Embodiment 1.

As shown in FIG. 5, the connection cords 31 and 32 are put together with an adhesive tape 9 at a position remote from the one ends 31A and 32A.

As shown in FIG. 2 and FIG. 3, the other ends of the connection cords 31 and 32 are connected to the connector 6 described above. A switch 32B is provided in the middle of the connection cord 32.

As shown in FIG. 3 and FIG. 5, the ring body 60 is disposed in the middle of the connection cords 31 and 32 in a state where both the connection cords 31 and 32 are inserted through in an opening 61 of the ring body 60.

Figure 4:
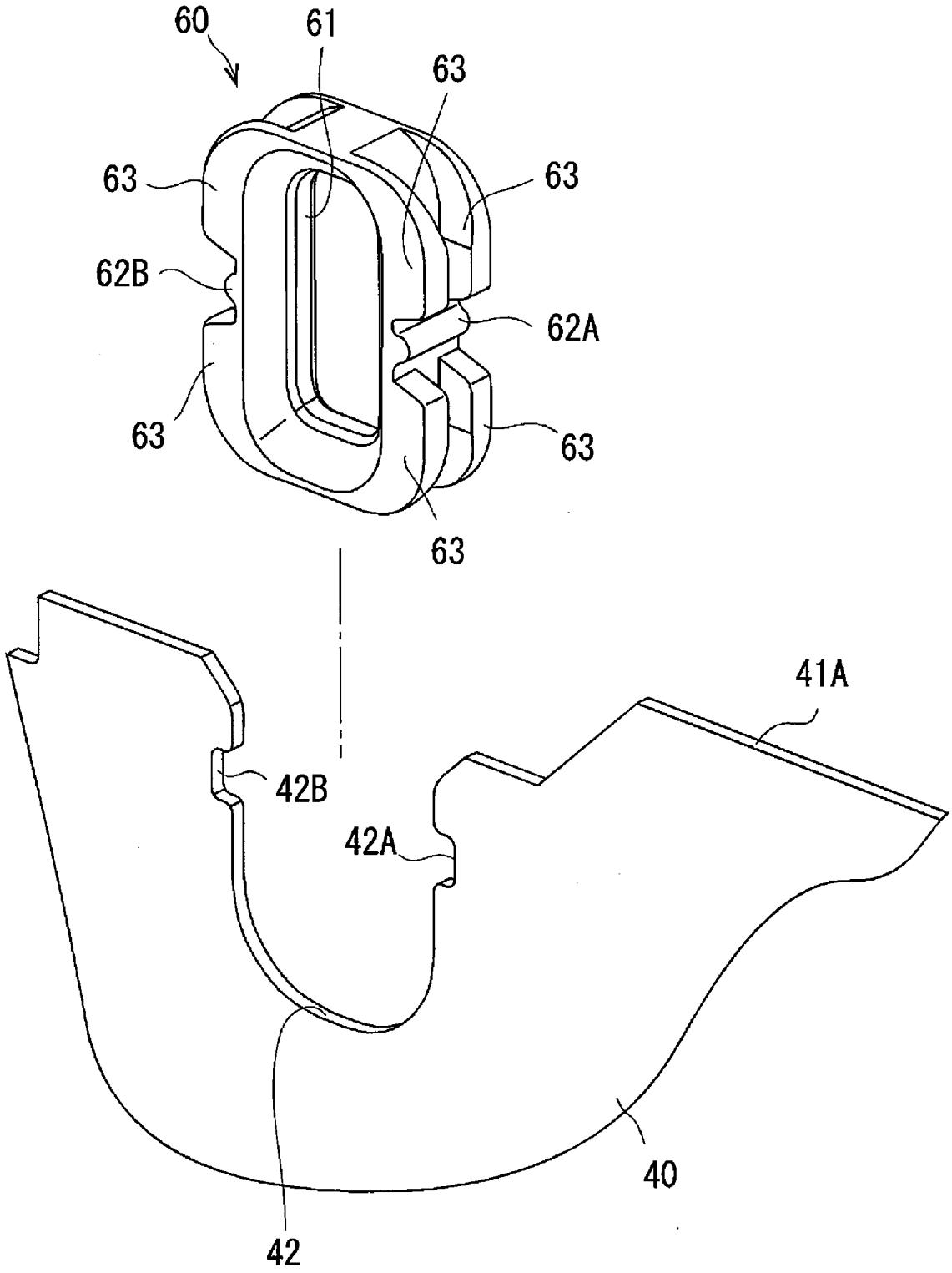
FIG. 4 is a partially enlarged perspective view showing a notch and a ring body in the image forming apparatus.

In this embodiment, the ring body 60 is manufactured by means of injection molding of thermoplastic resin, such as PET resin and PC resin. As shown in FIG. 4, the ring body 60 has the opening 61 of a generally rectangular shape extending vertically, and a pair of protruding portions 62A and 62B formed integrally to protrude outward in the radial direction from both sides of a outer peripheral surface defining the opening 61. The opening 61 has a size large enough to provide a clearance around the connection cords 31 and 32 when the connection cords 31 and 32 are inserted into the opening 61. Collar portions extending outward in the radial direction are formed on both end faces of the ring body 60 in its thickness direction. The collar portions 63 are of a shape in which they are removed in the vicinity of the respective protruding portions 62A and 62B. Because the opening 61 has a sufficient clearance with respect to the connection cords 31 and 32 inserted through inside and the collar portions 63 are removed in the vicinity of the respective protruding portions 62A and 62B, the ring body 60 readily undergoes elastic deformation in a direction in which the protruding portions 62A and 62B come in close proximity to each other.

As shown in FIG. 3, the casing 40 is formed with a generally U-shaped notch 42 on a short side of the opening edge 41A of the accommodation portion 41. As shown in enlargement in FIG. 4, a pair of rectangularly recessed portions 42A and 42B is formed on both side edges of the notch 42.

Figure 6:
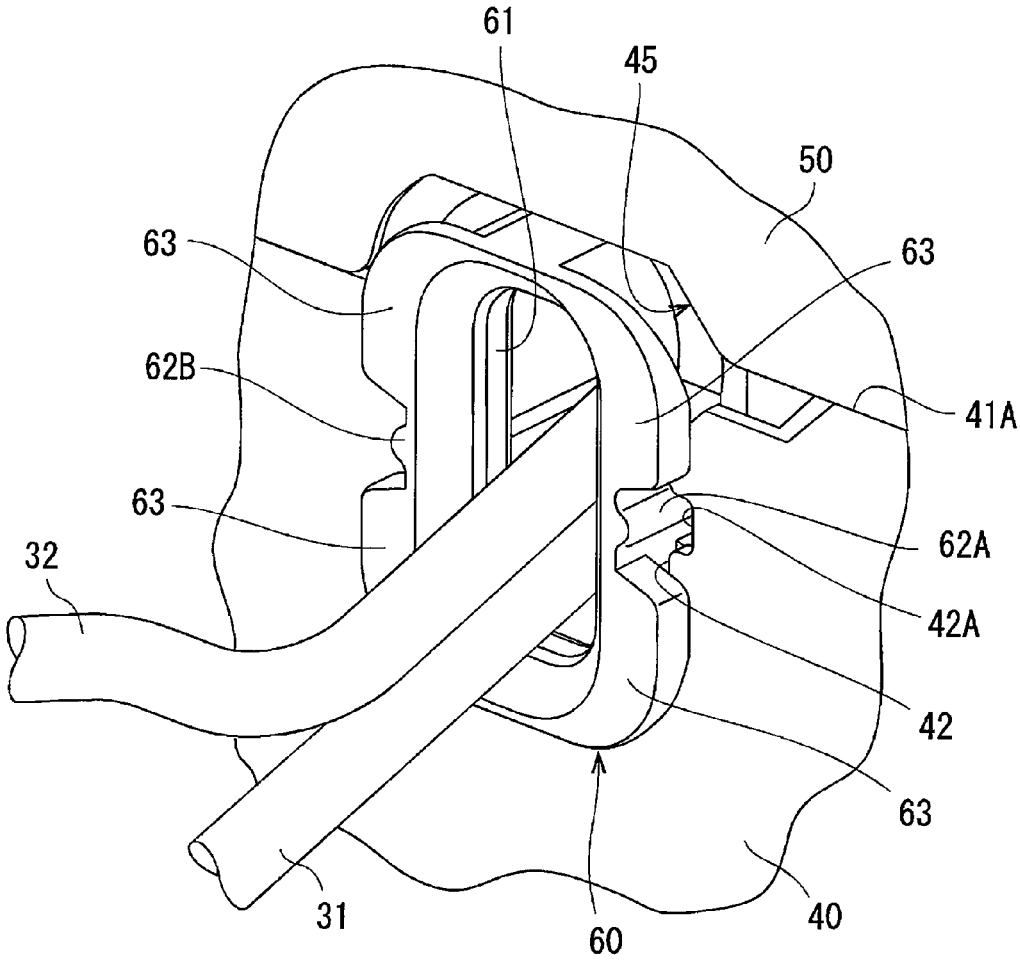
FIG. 6 is a partially enlarged perspective view showing the ring body and the connection cords in a state where they are attached to a cord insertion port in the image forming apparatus of Embodiment 1.

The recessed portions 42A and 42B correspond to engaging portions formed in the notch 42. The protruding portions 62A and 62B correspond to engaged portions that are formed in the ring body 60 and undergo elastic deformation to be engaged, respectively, with the recessed portions 42A and 42B as the engaging portions. When the ring body 60 is moved downward from a state shown in FIG. 4 and inserted into the notch 42, the protruding portions 62A and 62B abut on both side edges of the notch 42, which causes the ring body 60 to undergo elastic deformation in the direction in which the protruding portions 62A and 62B come into close proximity to each other. When the ring body 60 is fully pushed down into the notch 42 as shown in FIG. 6, the protruding portions 62A and 62B restore to the original state where they are spaced apart from each other and fit in the recessed portions 42A and 42B, respectively. In this instance, the collar portions 63 also pinch the notch 42 in the thickness direction.

The work procedure to assemble the substrate 20, the casing 40, and the lid body 50 forming the low-voltage power supply unit 10 will now be described.

The substrate 20 is accommodated in the accommodation portion 41 of the casing 40 in a state shown in FIG. 3. Meanwhile, as shown in FIG. 6, the ring body 60 is inserted into the notch 42 in a state where both the connection cords 31 and 32 are inserted through in the ring body 60. Accordingly, the ring body 60 is positioned with respect to the notch 42 as the protruding portions 62A and 62B are engaged with the recessed portions 42A and 42B, respectively. When the lid body 50 is assembled to the casing 40 from above, a lower end edge on the short side of the lid body 50 closes the notch 42 and the cord insertion port 45 is defined. The ring body 60 is thus attached to the cord insertion port 45. Consequently, the connection cords 31 and 32 are extracted from the low-voltage power supply unit 10.

The image forming apparatus 1 of Embodiment 1 includes the low-voltage power supply unit 10 including the substrate 20, a pair of the connection cords 31 and 32, the casing 40, the lid body 50, and the ring body 60 configured as above, as well as the housing 3. As has been described, when the lid body 50 is to be assembled to the casing 40, the ring body 60 is first inserted into the notch 42 in a state where both the connection cords 31 and 32 are inserted in the ring body 60. The ring body 60 is positioned in the cord insertion port 45 when the lid body 50 is assembled to the casing 40. Both the connection cords 31 and 32 are thus positioned within the notch 42 in a reliable manner, which eliminates the risk that both the connection cords 31 and 32 are pinched between the lid body 50 and the casing 40. The worker therefore becomes able to perform work to assemble the lid body 50 to the casing 40 with ease.

The image forming apparatus 1 of Embodiment 1 is thus capable of shortening a time needed for the assembly work. Also, because there is no risk that both the connection cords 31 and 32 are pinched between the lid body 50 and the casing 40, it is possible to prevent inconveniences, such as disconnection of both the connection cords 31 and 32 and a short occurring when they come into contact with the lid body 50 or the casing 40, in a reliable manner, which can in turn further enhance the safety of the low-voltage power supply unit 10.

In the image forming apparatus 1, the recessed portions 42A and 42B are formed in the notch 42 as the engaging portions, whereas the protruding portions 62A and 62B are formed in the ring body 60 as the engaged portions that undergo elastic deformation to be engaged with the recessed portions 42A and 42B, respectively. The ring body 60 is positioned with respect to the notch 42 when the protruding portions 62A and 62B are engaged with the concave portions 42A and 42B, respectively. Accordingly, in the image forming apparatus 1, the ring body 60 will not come off easily from the notch 42 when the lid body 50 is to be assembled to the casing 40. The worker therefore becomes able to perform work to assemble the lid body 50 to the casing 40 more easily.

Further, in the image forming apparatus 1, a pair of the recessed portions 42A and 42B as the engaging portions is formed on both side edges of the notch 42, whereas a pair of the protruding portions 62A and 62B as the engaged portions is formed so as to protrude outward in the radial direction from the outer peripheral surface of the ring body 60. The function and the effect of the invention can be achieved by the concrete configuration as above.

In the image forming apparatus 1, both the connection cords 31 and 32 are put together with the adhesive tape 9 in a partial segment between the substrate 20 and the notch 42. Accordingly, with the image forming apparatus 1, the worker becomes able to perform work to insert both the connection cords 31 and 32 in the ring body 60 with ease. In a case where the connection cords 31 and 32 are put together with a binding band, an inconvenience, such as damage, may possibly occur when the connection cords 31 and 32 are bound too tightly. However, such an inconvenience hardly occurs with the adhesive tape 9. Further, for example, even if the one end 31A of the one connection cord 31 comes off from the substrate 20 due to disconnection, because it is put together with the other connection cord 32 with the adhesive tape 9, it hardly comes into contact with the lid body 50 or the casing 40. A short therefore hardly occurs.

Embodiment 2

Figure 7:
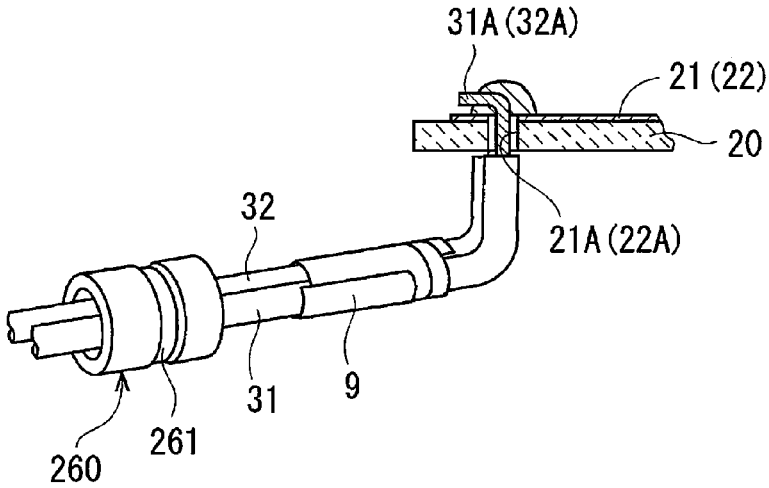
FIG. 7 is a perspective view (partial cross section) showing a substrate, connection cords, and a ring body when viewed in the direction indicated by the arrow V in FIG. 3 in an image forming apparatus of Embodiment 2.

An image forming apparatus of Embodiment 2 adopts a ring body 260 shown in FIG. 7 instead of the ring body 60 in the image forming apparatus 1 of Embodiment 1. Because the other configurations are the same as those of the image forming apparatus 1 of Embodiment 1, the ring body 260 will be described in detail and a description of the other configurations is omitted herein.

As shown in FIG. 7, the ring body 260 is a cylindrical body made of resin, and is formed with a groove 261 that goes around an outer peripheral surface of the ring body 260 at the center in the axial direction. The minor diameter of the groove 261 is of a size enough to be accommodated in the notch 42 while leaving a slight clearance and the width of the groove 261 is slightly larger than the thickness of the notch 42.

Even in the image forming apparatus of Embodiment 2 configured as above, the ring body 260 is first inserted into the notch 42 in a state where both the connection cords 31 and 32 are inserted in the ring body 260 when the lid body 50 is to be assembled to the casing 40. In this instance, both side faces defining the groove 261 pinch the notch 42 in the thickness direction. The ring body 260 is positioned in the cord insertion port 45 when the lid body 50 is assembled to the casing 40.

The image forming apparatus of Embodiment 2 has a drawback that the ring body 260 comes off from the notch 42 easily in comparison with Embodiment 1. Nevertheless, not only is the image forming apparatus capable of shortening a time needed for the assembly work, but also it is also capable of further enhancing the safety of the low-voltage power supply unit 10.

Embodiment 3

Figure 8:
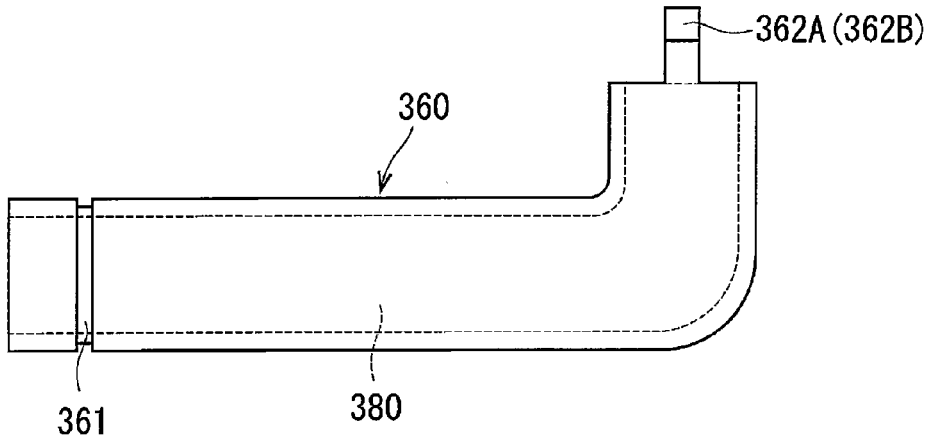
FIG. 8 is a side view of a ring body in an image forming apparatus of Embodiment 3.
Figure 9:
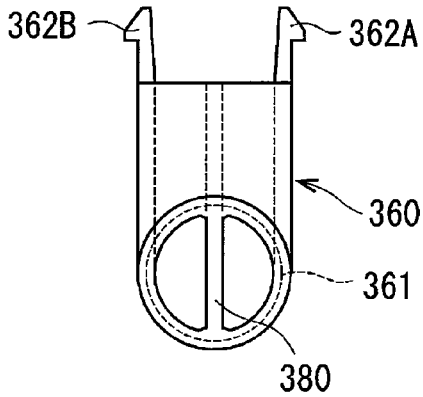
FIG. 9 is a front view of the ring body in the image forming apparatus of Embodiment 3.

An image forming apparatus of Embodiment 3 adopts a ring body 360 shown in FIG. 8 and FIG. 9 instead of the ring body 60 in the image forming apparatus 1 of Embodiment 1 and the substrate 20 is provided with through-holes 342A and 342B as engaging portions. Because the other configurations are the same as those of the image forming apparatus 1 of Embodiment 1, the ring body 360 and the through-holes 342A and 342B will be described in detail and a description of the other configurations is omitted herein.

As shown in FIG. 8 and FIG. 9, the ring body 360 is a generally bent cylindrical long body made of resin.

The ring body 360 is formed with a groove 361 that goes around an outer peripheral surface of the ring body 360 at an end portion on a side to be attached to the notch 42 (on the left side in FIG. 8). Because the groove 361 is identical in shape to the groove 261 described above, a description thereof is omitted herein.

An end portion of the ring body 360 on the substrate 20 side is bent at right angles and faces upward so as to go along a path in which the connection cords 31 and 32 are disposed. The end portion of the ring body 360 on the substrate 20 side is formed integrally with a pair of key claws 362A and 362B. The key claws 362A and 362B protrude upward and are disposed facing each other in a radial direction of the ring body 360 (right-left direction in FIG. 9).

A partition wall 380 extending in the axial direction is formed inside the ring body 360 so as to isolate the respective connection cords 31 and 32. In this embodiment, the partition wall 380 is formed continuously from one end to the other end of the ring body 360. However, it is sufficient to form the partition wall 380 at least in a partial segment.

Figure 10:
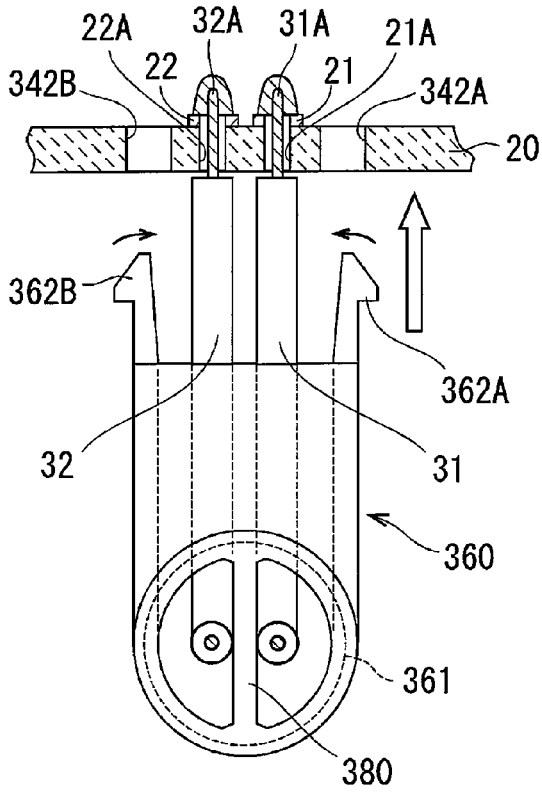
FIG. 10 is a front view (partial cross section) showing a state before key claws of the ring body are engaged with through-holes in the substrate in the image forming apparatus of Embodiment 3.
Figure 11:
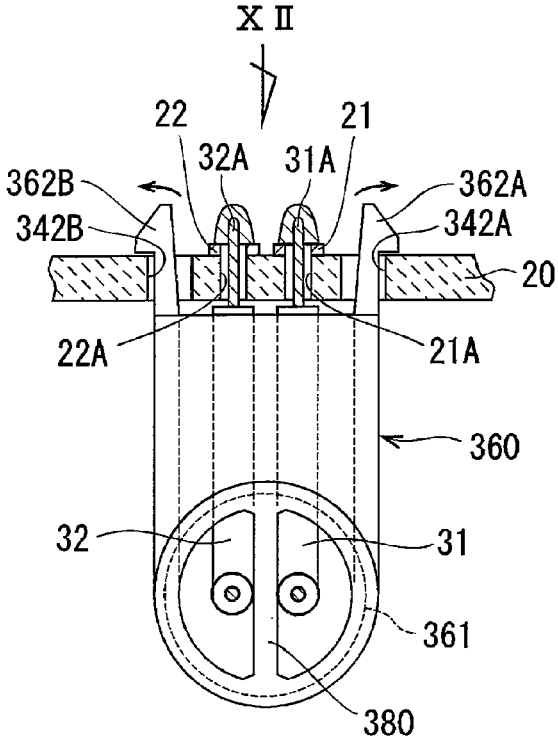
FIG. 11 is a front view (partial cross section) showing a state after the key claws of the ring body are engaged with the through-holes in the substrate in the image forming apparatus of Embodiment 3.
Figure 12:
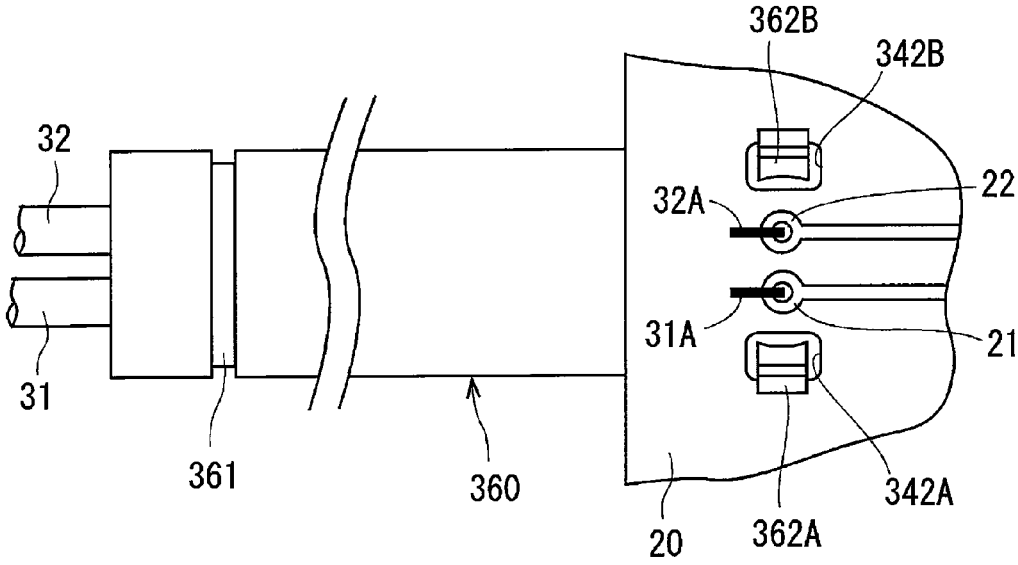
FIG. 12 is a top view (when viewed from a direction indicated by an arrow XII in FIG. 11) showing a state after the key claws of the ring body are engaged with the through-holes in the substrate in the image forming apparatus of Embodiment 3.

As shown in FIG. 10 through FIG. 12, the through-holes 342A and 342B are disposed so as to have the wiring end portions 21 and 22 in between. As shown in FIG. 12, the through-holes 342A and 342B are rectangular holes of a size large enough, respectively, for the key claws 362A and 362B to pass through. An interval between the through-holes 342A and 342B is made slightly smaller than an interval between the key claws 362A and 362B.

The through-holes 342A and 342B correspond to the engaging portions formed in the substrate 20. Also, the key claws 362A and 362B correspond to engaged portions that are formed in the ring body 360 and undergo elastic deformation to be engaged, respectively, with the through-holes 342A and 342B as the engaging portions. As shown in FIG. 10, the one ends 31A and 32A of the connection cords 31 and 32 are soldered to the wiring end portions 21 and 22, respectively, in a state where the ring body 360 is spaced apart below from the substrate 20. Then, when the ring body 360 is moved upward so that the key claws 362A and 362B are inserted into the through-holes 342A and 342B, respectively, the ring body 360 undergoes elastic deformation in such a manner that the key claws 362A and 362B come into close proximity to each other. Then, as shown in FIG. 11, when the ring body 360 is moved up until it abuts on the bottom face of the substrate 20, the key claws 362A and 362B pass through the through-holes 342A and 342B, respectively, and restore to the original state where they are spaced apart from each other, which allows the key claws 362A and 362B to be engaged with the through hole-holes 342A and 342B, respectively. Consequently, as shown in FIG. 12, because the ring body 360 is positioned with respect to the substrate 20, it becomes difficult for the end portion of the ring body 360 on the notch side to oscillate. Accordingly, once the substrate 20 is fixedly accommodated inside the accommodation portion 41, the ring body 360 is indirectly positioned in the notch 42.

Figure 13:
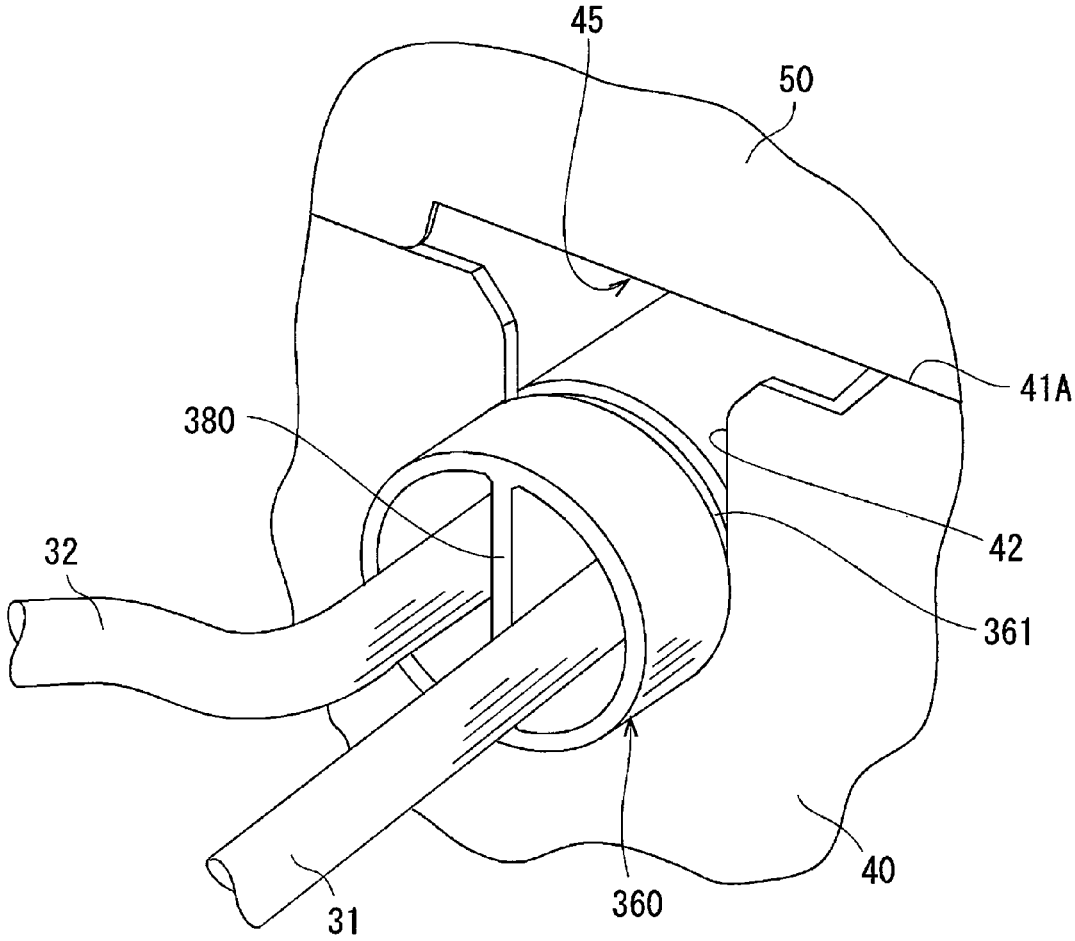
FIG. 13 is a partially enlarged perspective view showing the ring body and connection cords in a state where they are attached to a cord insertion port in the image forming apparatus of Embodiment 3.
Figure 14:
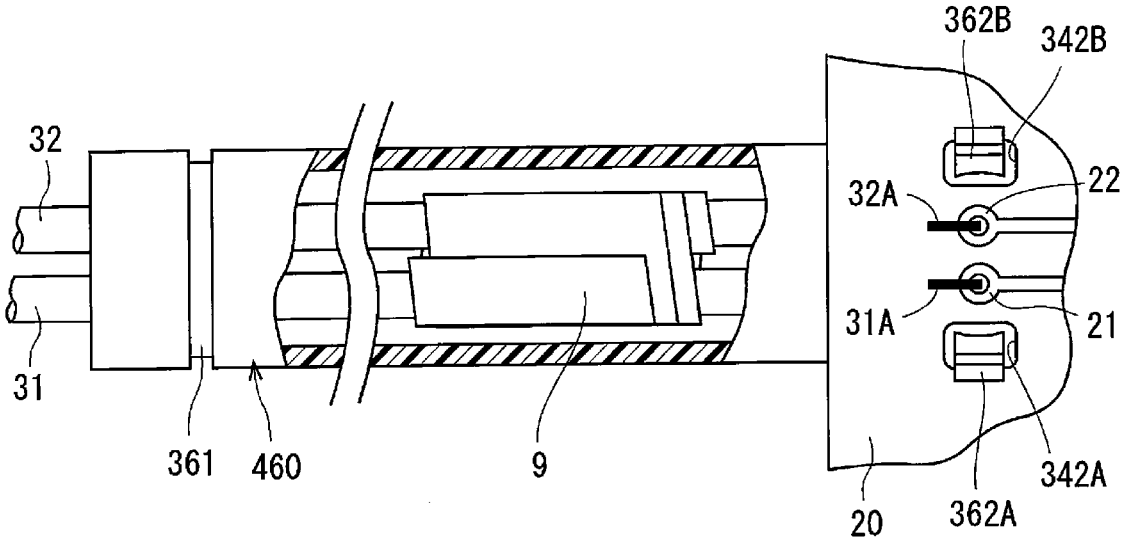
FIG. 14 is a top view (when viewed in the direction indicated by the arrow XII in FIG. 11) showing a state after key claws of a ring body are engaged with through-holes of a substrate in an image forming apparatus of Embodiment 4.
Figure 15:
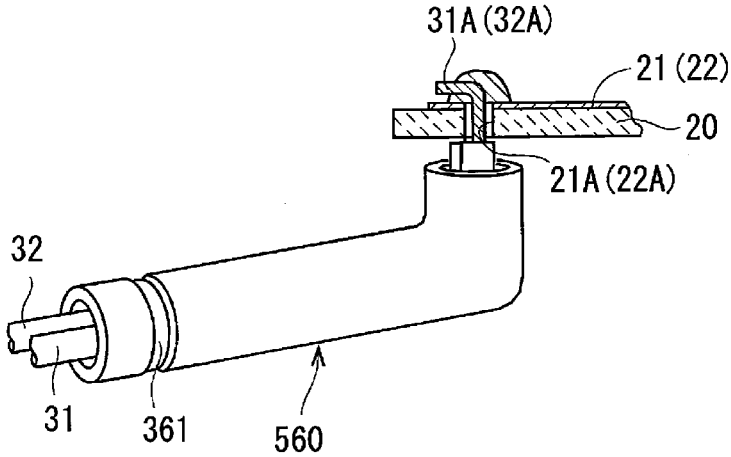
FIG. 15 is a perspective view showing a substrate, connection cords, and a ring body when viewed in the direction indicated by the arrow V in FIG. 3 in an image forming apparatus of Embodiment 5.

Even in the image forming apparatus of Embodiment 3 configured as above, as shown in FIG. 13, the ring body 360 is first inserted into the notch 42 in a state where both the connection cords 31 and 32 are inserted in the ring body 360 when the lid body 50 is to be assembled to the casing 40. The ring body 360 is positioned in the cord insertion port 45 when the lid body 50 is assembled to the casing 40.

Hence, not only is the image forming apparatus of Embodiment 3 capable of shortening a time needed for the assembly work, but also it is capable of further enhancing the safety of the low-voltage power supply unit 10.

In this image forming apparatus, the substrate 20 is formed with the through-holes 342A and 342B as the engaging portions, whereas the ring body 360 is provided with the key claws 362A and 362B as the engaged portions that undergo elastic deformation to be engaged with the through-holes 342A and 342B, respectively. The ring body 360 is positioned indirectly with respect to the notch 42 as the key claws 362A and 362B are engaged with the through-holes 342A and 342B, respectively. Accordingly, in this image forming apparatus, as with the image forming apparatus of Embodiment 1, the ring body 360 will not come off easily from the notch 42. The worker thus becomes able to perform work to assemble the lid body 50 to the casing 40 more easily.

Further, in this image forming apparatus, the ring body 360 is a long body extending from the notch 42 to the substrate 20 and includes the partition wall 380. Hence, in this image forming apparatus, it is possible to prevent the connection cords 31 and 32 from coming into contact with each other and the connection cords 31 and 32 from coming into contact with the casing 40 or the lid body 50 in a reliable manner. The safety of the low-voltage power supply unit 10 can be therefore enhanced further.

Embodiment 4

An image forming apparatus of Embodiment 4 adopts a ring body 460 (shown in FIG. 14), which is the ring body 360 in the image forming apparatus of Embodiment 3 from which the partition wall 380 is omitted. The connection cords 31 and 32 are put together with the adhesive tape 9 inside the ring body 460. Because the other configurations are the same as those of the image forming apparatus of Embodiment 3, a description thereof is omitted herein.

The image forming apparatus of Embodiment 4 configured as above can also achieve the function and the effect of the invention as in the image forming apparatus of Embodiment 3.

Also, because the ring body 460 is a long body extending to the substrate 20, the adhesive tape 9 can be wound around the connection cords 31 and 32 at a position moderately remote from the substrate 20 where heat of soldering is hardly transmitted. It is therefore possible to prevent the adhesive tape 9 from peeling due to heat of soldering.

Embodiment 5

An image forming apparatus of Embodiment 5 adopts a ring body 560 (shown in FIG. 15), which is the ring body 460 in the image forming apparatus of Embodiment 4 from which the key claws 362A and 362B are omitted. The connection cords 31 and 32 are put together with the adhesive tape 9 inside the ring body 560. Because the other configurations are the same as those of the image forming apparatus of Embodiment 4, a description thereof is omitted herein.

The image forming apparatus of Embodiment 5 configured as above has a drawback that the ring body 560 readily comes off from the notch 42 in comparison with Embodiments 3 and 4 because of the absence of the key claws 362A and 362B as the engaged portions. Nevertheless, it can achieve the function and the effect of the invention.

While the invention has been described in accordance with Embodiments 1 through 5, it should be appreciated that the invention is not limited to Embodiments 1 through 5 above. It goes without saying that the invention can be modified as needed without deviating from the scope of the invention.

Regarding the resin material forming the ring body, any resin material can be used as long as the function and the effect of the invention can be achieved. However, resin that has a moderate shape retaining property on the one hand and readily undergoes elastic deformation on the other hand is preferable. In particular, it is preferable to adopt PET resin, PC resin, and so forth.

The invention can be used in an image forming apparatus.

What is claimed is:

1. An image forming apparatus, comprising:

a housing; and a low-voltage power supply configured to be accommodated in the housing, wherein the low-voltage power supply includes:

a substrate provided with a low-voltage power supply circuit, the substrate including an engaging portion;

a pair of connection cords each soldered to the substrate at one end and connected to an external power supply that supplies power to the low-voltage power supply circuit at the other end;

a casing made of metal and provided with an accommodation portion inside which the substrate is fixedly accommodated and a notch made in a part of an opening edge of the accommodation portion;

a lid body made of metal and configured to cover the accommodation portion when assembled to the casing while abutting on the opening edge and to define a cord insertion port by closing the notch;

a ring body made of resin and configured to be inserted into the notch in a state where both the connection cords are inserted in the ring body and to be attached to the cord insertion port when the lid body is assembled to the casing, the ring body including an engaged portion that is configured to undergo elastic deformation when engaged with the engaging portion; and a partition wall configured to isolate the connection cords formed in an axial direction inside the ring body, wherein the ring body is positioned with respect to the notch when the engaged portion is engaged with the engaging portion, wherein the engaging portion is a pair of through-holes in the substrate, wherein the ring body is a long body extending from the notch to the substrate, and wherein the engaged portion is a pair of key claws protruding toward both the through-holes from an end portion of the ring body on a side of the substrate.

2. The image forming apparatus according to claim 1, wherein:

both the connection cords are put together with an adhesive tape at least in a partial segment between the substrate and the notch.

3. The image forming apparatus according to claim 1, wherein the partition wall and the each key of claws are integrally formed with the ring body.

* * * * *